US008952770B2

(12) United States Patent
Lau

(10) Patent No.: US 8,952,770 B2
(45) Date of Patent: Feb. 10, 2015

(54) SELF KEYING AND ORIENTATION SYSTEM FOR A REPEATABLE WAVEGUIDE CALIBRATION AND CONNECTION

(71) Applicant: OML, Inc., Morgan Hill, CA (US)

(72) Inventor: Yuenie Lau, San Jose, CA (US)

(73) Assignee: OML, Inc., San Jose, CA (US)

( * ) Notice: Subject to any disclaimer, the term of this patent is extended or adjusted under 35 U.S.C. 154(b) by 105 days.

(21) Appl. No.: 13/924,406

(22) Filed: Jun. 21, 2013

(65) Prior Publication Data

US 2013/0342288 A1 Dec. 26, 2013

Related U.S. Application Data

(60) Provisional application No. 61/662,404, filed on Jun. 21, 2012.

(51) Int. Cl.

| | |
|---|---|
| ***H01P 1/00*** | (2006.01) |
| ***H01P 5/00*** | (2006.01) |
| ***H01P 3/127*** | (2006.01) |
| ***H01P 11/00*** | (2006.01) |
| ***H01P 1/04*** | (2006.01) |

(52) U.S. Cl.

CPC ..... *H01P 3/127* (2013.01); *H01P 11/002* (2013.01); *H01P 1/042* (2013.01)

USPC ..... 333/255; 333/254; 333/260

(58) Field of Classification Search

USPC ..... 333/245–263

See application file for complete search history.

(56) References Cited

U.S. PATENT DOCUMENTS

| | | | | |
|---|---|---|---|---|
| 5,091,709 | A * | 2/1992 | Pollard | 333/239 |
| 5,148,593 | A * | 9/1992 | Walter | 29/600 |
| 7,791,438 | B2 | 9/2010 | Lau et al. | |
| 7,896,574 | B2 * | 3/2011 | Nolle et al. | 404/25 |
| 8,542,079 | B2 * | 9/2013 | Sherrer et al. | 333/34 |
| 2002/0125971 | A1 * | 9/2002 | Sciarrino | 333/254 |
| 2013/0342288 | A1 * | 12/2013 | Lau | 333/255 |

* cited by examiner

*Primary Examiner* — Brandon S Cole

(74) *Attorney, Agent, or Firm* — Temmerman Law Office; Matthew J. Temmerman

(57) ABSTRACT

The self-keying waveguide interconnection system for repeatable waveguide calibration and connection comprises a plug with a centrally disposed aperture, a jack provided with a counterbore to accept a plug diameter. The jack includes a plurality of self-keying channels. A shim having a shape complementary to the plurality of self keying thru slots has a plurality of self keying thru slots for aligning the centrally disposed aperture of the plug to the centrally disposed aperture of the jack. The system identifies the orientation and flange face polarity of the line or adapter without the use of alignment pins as two or more of these independent waveguide interfaces are coupled. In use, the device functions as a self-keying shim/spacer/adapter for a calibration kit or adapter in waveguide sections.

19 Claims, 8 Drawing Sheets

SELF KEYING AND ORIENTATION SYSTEM FOR A REPEATABLE WAVEGUIDE CALIBRATION AND CONNECTION

RELATED APPLICATIONS

This application is a Nonprovisional Application of and claims priority to U.S. Provisional Patent Application 61/662,404, filed Jun. 21, 2012. This patent application is incorporated herein in its entirety as if set out in full.

BACKGROUND OF THE DISCLOSURE

1. Technical Field of the Disclosure

The present embodiment is related in general to electromagnetic waveguide interconnection systems, and in particular to a self-keying and orientation system to establish a repeatable waveguide calibration and connection for millimeter wave and sub-millimeter wave applications.

2. Description of the Related Art

Waveguides are used to transmit electromagnetic wave energy such as X-Rays, visible light, or sound waves from one point to another. The waveguide type is selected depending on the frequency of the wave to be propagated. The most common waveguide design is a simple hollow metal conductor tube inside which the wave travels, eventually exiting and propagating outward and away from the exit point of the tube. For transmitting waves through different mediums, a special type of waveguide is employed. This type of waveguide wherein the wave is kept in a confined medium includes, for example, air-filled waveguides, dielectric filled waveguides, slot-line waveguides, slot-based waveguides, and others. In these systems, the waveguide interface is the only physical means to connect different waveguide components together to allow the waves to propagate therethrough.

In waveguide applications, accurate and repeatable measurements depend on the quality of interface used. The use of calibration kits is necessary for removing systematic errors and thereby increasing the accuracy of measurements. The components of the calibration kit interface are a crucial factor in the calibration success. Conventional waveguide systems employ mechanical clamps with waveguide interfaces to efficiently transmit electromagnetic waves through the waveguide. Typical waveguides are made from materials such as brass, copper, silver, aluminum, or any other metal exhibiting low bulk resistivity. Waveguide structures have conventionally been assembled in several ways. Dip-brazing is a process for joining aluminum waveguides. A thin doping layer is applied at the point of connection, thereby lowering the melting point at that one contact point so the waveguides may be joined. Electroforming allows the entire waveguide structure to be built up layer by layer through electroplating. Other methods include electronic discharge machining and computerized numerically controlled machining.

Waveguides are becoming more commonly used in the millimeter wave and sub-millimeter wave industry, which includes frequencies above 30 GHz. This high band of electromagnetic waves is beginning to be used on many new devices and services, such as high-resolution radar systems, point-to-point communications, and point-to-multipoint communications. Higher frequency waves require a smaller waveguide, meaning that for millimeter wave and sub-millimeter wave ranges, the waveguides must be machined very precisely. At the smallest sizes even the highest machining tolerances conventionally available begin to present problems. The effect of waveguide misalignment is degraded electrical performance of the waveguide, such as increased voltage standing wave ratio (VSWR). The more accurately the waveguide interfaces are aligned, the better behaved and more predictable is the waveguide system performance.

The most common and accurate 2-port waveguide calibration system uses the Thru-Reflect-Line (TRL) calibration connection. The thru portion of the system simply connects the two independent waveguide reference planes together. The reflective portion of the system which includes a mirror finish metal, connects a waveguide short to each of the reference planes, while the line portion of the system connects a shim of predetermined length between the two independent reference planes. In the thru condition, each of the reference planes' waveguide apertures needs to be matched perfectly to each other. For the reflective condition, the only requirement is to have a material with mirror-like finish at the interface to reflect all incident electromagnetic waves. In the line condition, the shim's waveguide aperture must match both waveguide reference planes' apertures simultaneously.

Another conventional means for interfacing waveguide apertures between different waveguide sections uses two fixed outer alignment pins disposed opposite one another on a circular waveguide interface. The tolerances of this alignment method are too loose for many applications and result in unacceptable levels of mismatches in some millimeter wave applications. To correct for this, a more advanced system uses removable alignment pins having much tighter tolerances. The removable alignment pins are generally located just above and below the waveguide aperture. In applications that approach sub-millimeter wave frequencies, even the removable center alignment pins of a relatively tighter tolerance have proven to be insufficient to maintain an adequately aligned aperture interface. The Lau-Denning interface disclosed in U.S. Pat. No. 7,791,438 issued to Lau on Sep. 7, 2010, hereinafter referenced below as "The Lau-Denning interface", addresses the critical single interface connection mismatch issue but lacks a clear definition of addressing the multiple interface single connection such as the shim in the TRL calibration.

Based on the foregoing there is a need for an improved waveguide interface that offers a solution to the multiple interface single connection issue unresolved by the Lau-Denning interface. The needed waveguide interface would provide a reliable self-keying and orientation system for establishing a repeatable waveguide calibration and connection. In addition, the needed system would provide a visual aid to a user to ensure that a flange interface polarity is maintained and that angular rotation is aligned to within less than 1°. Finally, the needed system would be able to provide a solution for accurate waveguide interface without the use of alignment pins or any other types of alignment mechanism.

SUMMARY OF THE DISCLOSURE

To minimize the limitations found in the prior art, and to minimize other limitations that will be apparent upon the reading of this specification, the preferred embodiment of the present invention provides a self-keying and orientation system to establish a repeatable waveguide calibration and connection for millimeter wave and sub-millimeter wave applications.

The present invention discloses a self keying waveguide interconnection system that preserves the same ultra precision Lau-Denning interface and identifies the orientation and flange face polarity of the line or adapter without the use of alignment pins as two or more of these independent waveguide interfaces are coupled. The self-keying precision waveguide interface comprises at least one slot as the self-keying element and may be a flush, recessed or, protruding rim. In other embodiments more than one slot may be present. In use, the device functions as a self-keying shim/spacer/adapter for a calibration kit or adapter in waveguide sections.

The self-keying waveguide interconnection system for repeatable waveguide calibration and connection disclosed herein comprises a first member having a plug component provided with a protruding surface with a centrally disposed aperture. The centrally disposed aperture enables connection to a first duct of a waveguide for transmission of electromagnetic waves in the millimeter and sub-millimeter range. A second member, the second member being a jack provided is with a counterbore complimentary to the protruding surface to accept a plug diameter. The second member includes a plurality of self-keying channels. The counterbore includes a centrally disposed aperture for connection to a second duct so as to join the first duct to the second duct. A shim having a shape complementary to the plurality of self-keying thru channels is sized so as to position within the counterbore and a plurality of self-keying thru slots. The shim has a centrally disposed aperture for aligning the centrally disposed aperture of the first member to the centrally disposed aperture of the second member. The shim has a width less than a counterbore depth. The shim accurately fits onto the counterbore and the self-keying thru slots of the second member to align the centrally disposed apertures of the first member, the second member and the shim to maintain integrity of the electrical performance of the self-keying waveguide.

It is thus a first object of the present invention to present a solution to the multiple interface single connection issue of the Lau-Denning interface.

It is a further object of the present invention to present a self-keying and orientation system for establishing a repeatable waveguide calibration and connection.

It is a further object of the present invention to provide a visual aid to the user to ensure flange interface polarity is maintained and that angular rotation is aligned to within less than 1°.

It is a further object of the present invention to provide a waveguide connection solution without the use of alignment pins or any other types of alignment mechanism.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

A self-keying and orientation system is used for establishing a repeatable waveguide calibration and connection for use with different components such as mixers, multiplier, circulators, isolators, attenuators, filters, etc. Millimeter wave and sub-millimeter wave applications demand the use of a very high precision waveguide aperture interface so as to minimize mismatches that are detrimental to the overall system operation and performance. In particular, calibration standards such as $\lambda/8$, $\lambda/4$, $3\lambda/8$, $5\lambda/8$ and $7\lambda/8$ line or adapters require the matching of two independent interfaces simultaneously during calibration or when extending system connections and must approach the ideal waveguide aperture interface condition for the best overall system performance.

Figure 6:
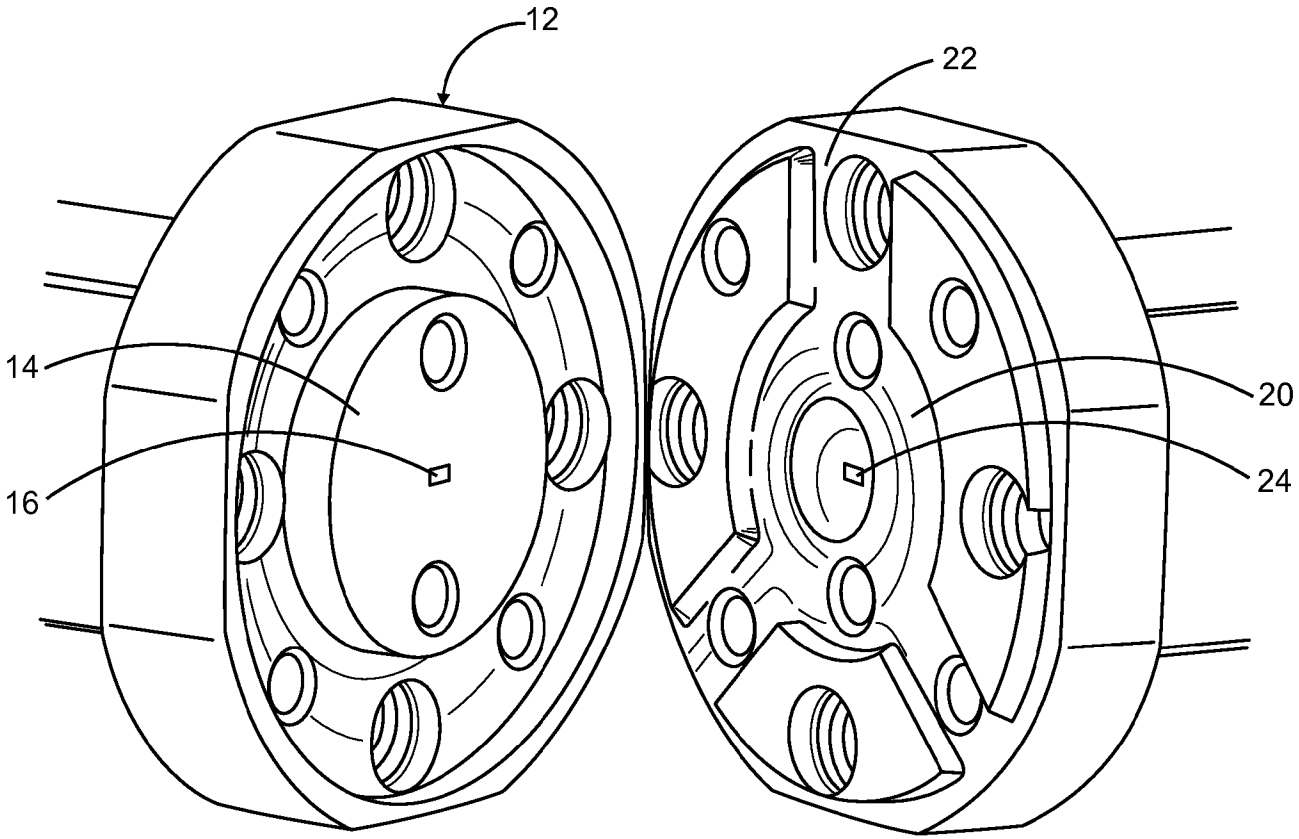
FIG. 6 is a perspective view of the plug and the jack having a plurality of self keying thru slots according to a preferred embodiment of the invention.
Figure 7:
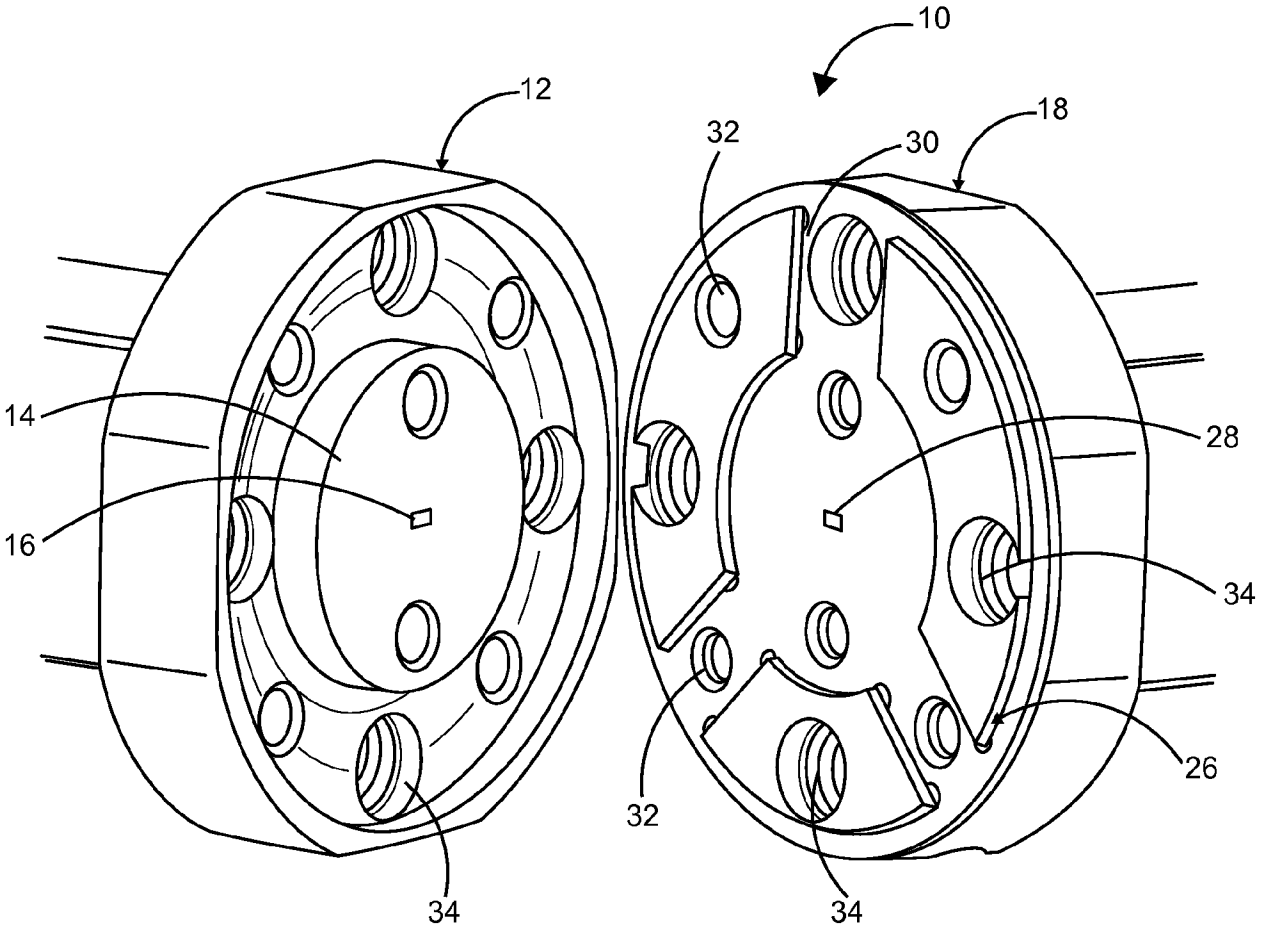
FIG. 7 is a perspective view of the plug and the shim positioned on the plurality of self keying channels of the jack according to a preferred embodiment of the invention.

Referring first to FIGS. 6 and 7, wherein FIG. 6 shows a plug and a jack and FIG. 7 shows the plug and the jack with a shim positioned on the jack, a self keying waveguide interconnection system 10 according to a preferred embodiment of the present invention comprises a first member, which is a plug component 12 provided with a protruding surface 14 having a centrally disposed aperture 16. An opposite side of the plug component 12 is configured for connection to a first duct (not shown). A second member of the self-keying waveguide interconnection system 10 is a jack 18 provided with a counterbore 20 complimentary to the protruding surface 14 to accept a plug diameter. The second member includes a plurality of self-keying channels 22 for receiving a plurality of self-keying thru slots 30. The counterbore 20 includes the centrally disposed aperture 24 for connection to a second duct (not shown) to join the first duct (not shown) to the second duct (not shown) for transmitting the electromagnetic wave. A shim 26, shown alone in FIG. 8 and attached to jack 18 in FIG. 7, has a shape complementary to the plurality of self keying thru slots 30 and has dimensions to position within the counterbore 20 and the plurality of self keying channels 22. The shim 26 includes a centrally disposed aperture 28 for aligning the centrally disposed aperture 16 of the plug component 12 to the centrally disposed aperture 24 of the jack 18. To fully recess within the plurality of self-keying channels 22 of the jack 18, the shim 26 is designed to have a width less than the depth of the counterbore 20. Since the shim 26 accurately fits onto the counterbore 20 and the self-keying channels 22 of the jack 18 precisely align with the centrally disposed apertures 16, 24 and 28 of the plug component 12, the jack 18 and the shim 26 maintain the integrity of the electrical performance of the self keying waveguide.

Figure 1A:
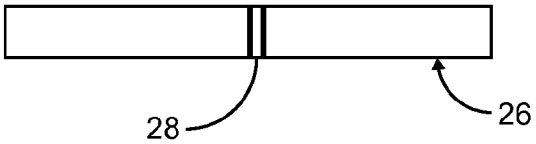
FIG. 1A is a front view of a shim of a self keying waveguide interconnection system showing a position of a centrally disposed aperture according to a preferred embodiment of the invention.
Figure 1B:
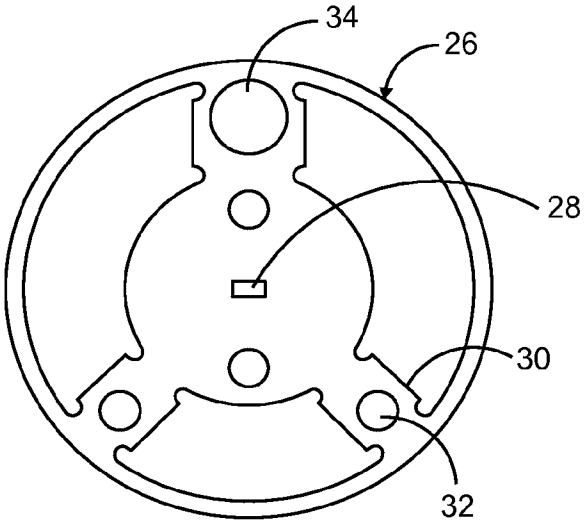
FIG. 1B is a top view of the shim of the self keying waveguide interconnection system according to a preferred embodiment of the invention.
Figure 3:
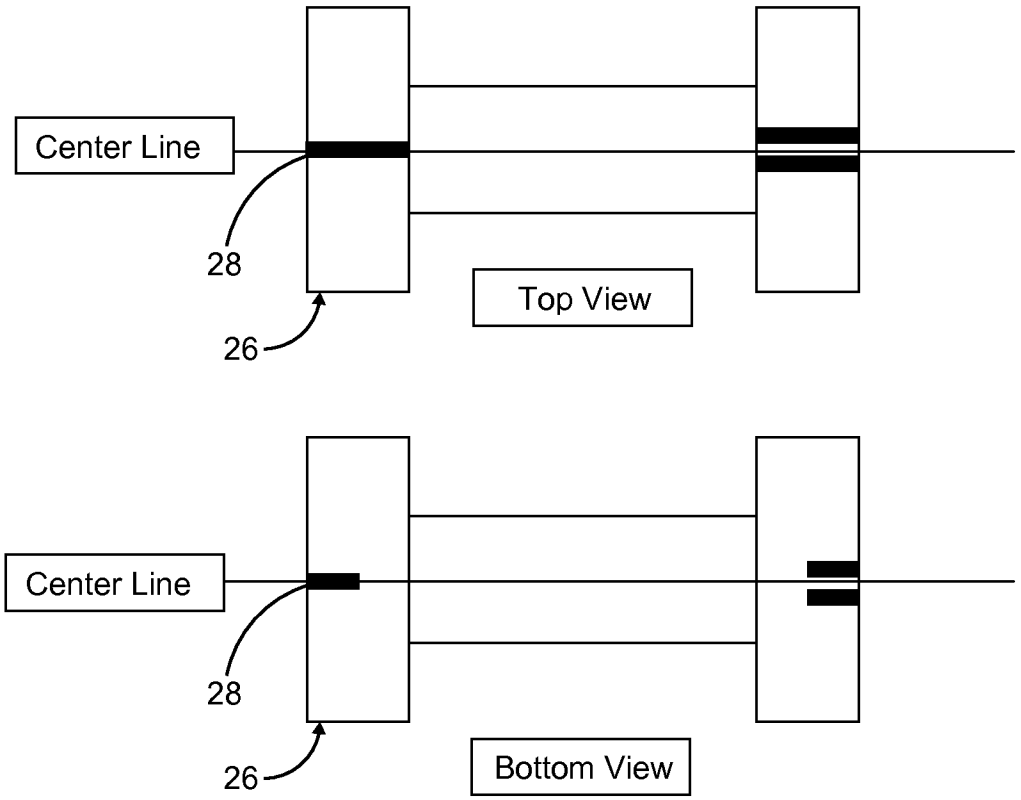
FIG. 3 is a first diagrammatic image depicting a simple method of assuring a flange face orientation and a visual angular rotation of a conventional waveguide used with the self keying waveguide interconnection system.
Figure 8:
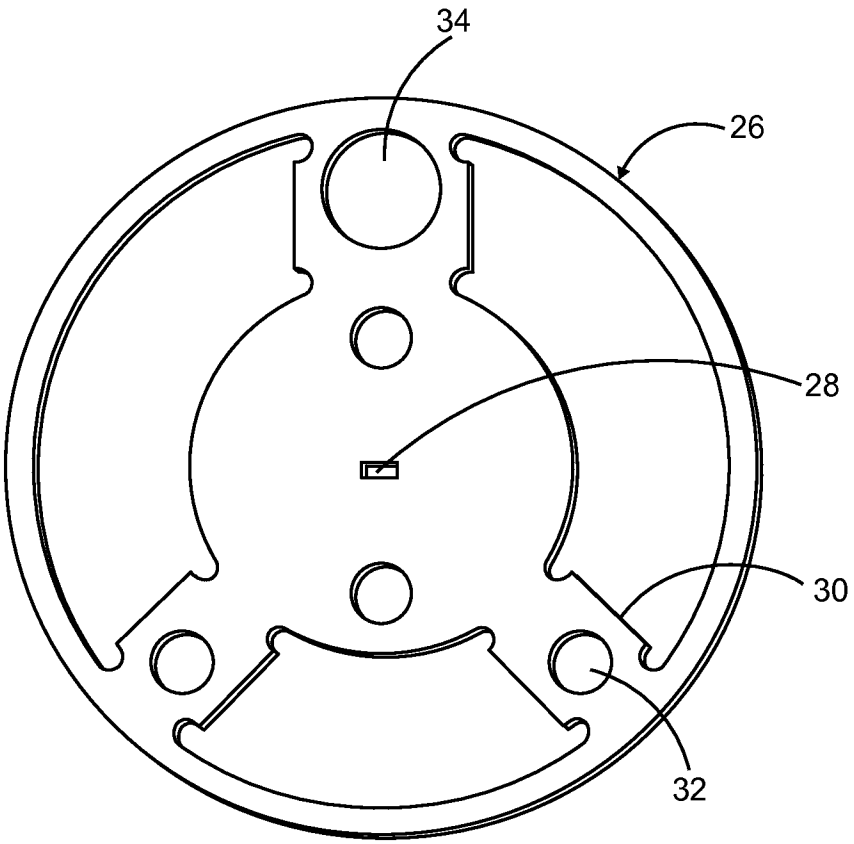
FIG. 8 is a top perspective view of the shim having a shape complementary to the plurality of self-keying channels according to a preferred embodiment of the invention.

Whereas FIG. 8 is a top perspective view of shim 26, FIG. 1A is a top view of the shim 26 of the self-keying waveguide interconnection system 10 showing a position of the centrally disposed aperture 28 according to a preferred embodiment of the invention. The front view shown in FIG. 1B depicts the shim or adapter 26 comprising at least one self-keying thru slot or at least on self-keying non-thru slot 30. The self-keying features allow the device to maintain an ultra precise interface coupling without the use of alignment pins. The self keying thru slots 30 when aligned with the plurality of self keying channels 22 provided on the jack 18 forms a precision alignment of the centrally disposed aperture 28 of the shim 26 and a centrally disposed aperture 24 in a counterbore 20 of the jack 18. This waveguide can be used in the transmission of electromagnetic waves in the millimeter wave and sub-millimeter wave applications range and above. The self-keying waveguide interconnection system 10 preferably comprises a first 0.015" wide groove 32 across the top of the shim 26 and preferably at the center of the shim 26 (90°) and a second 0.015" wide groove 32 offset from the center by 0.30". It may be offset from the 90° center either on the 90° center left side or the 90° center right side. A total misalignment of the 0.015" wide groove 32 represents a 1° angular rotation. Alternate embodiments of the self-keying waveguide interconnection system 10 may include other widths and spacing between grooves other than the 0.015" wide groove 32 is described above, such as a range of between 0.005"and 0.015" or less preferably between 0.005" and 0.075". This component assists a user to as a visual aid to align angular rotation to within less than 1°. When coupled to another waveguide flange as depicted in FIG. 3, it also indicates flange interface polarity so that same mating interface polarity is maintained when the components are re-attached after detachment. The above-described self keying waveguide interconnection system 10 is 100% compatible with MIL-DTL-3922/67D interface. The plug or boss component 12 remains the same as the original Lau-Denning interface with the boss diameter increased to visually associate with the MIL-DTL-3922/67D inner boss diameter.

Figure 2C:
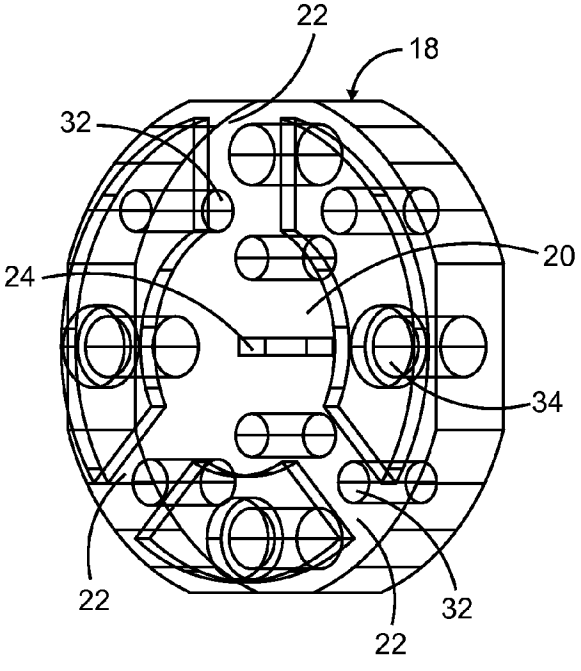
FIG. 2C is a transparent perspective view of a shim of the self keying waveguide interconnection system according to a preferred embodiment of the present invention.
Figure 2B:
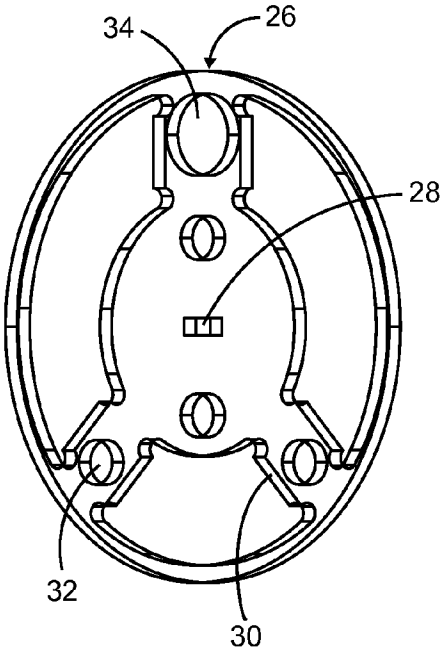
FIG. 2B is a transparent perspective view of a jack of the self keying waveguide interconnection system.
Figure 2A:
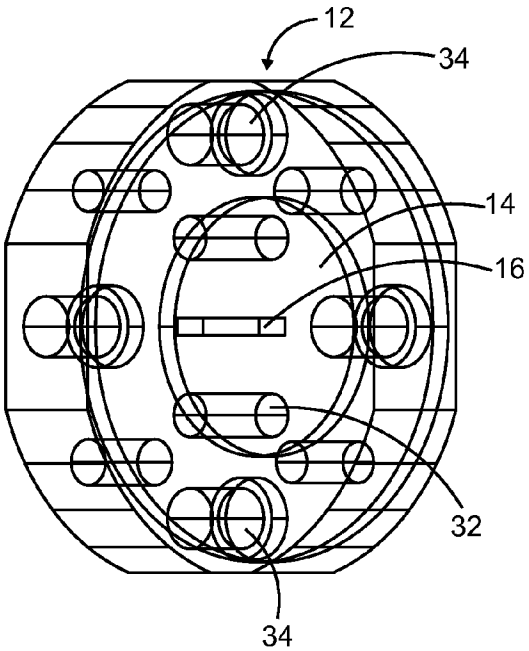
FIG. 2A is a transparent perspective view of a plug of the self keying waveguide interconnection system.

FIG. 2A is a transparent perspective view of the plug component 12 of the self-keying waveguide interconnection system 10. The protruding surface 14 of the plug component 12 may have a circular shape and is located at a center of the plug component 12. The protruding surface 14 of the plug component 12 includes a plurality of grooves 32 to align with the wide grooves 32 provided on the shim 26 and the jack 18. This will ensure precise alignment of the plug component 12 and the shim 26 without the use of alignment pins with the plug component 12. FIG. 2B is a transparent perspective view of the shim 26 of the self-keying waveguide interconnection system 10. The centrally disposed aperture 24 of the shim 26 aligns with the centrally disposed aperture 24 of the jack 18 and kept in the aligned position with the help of a plurality of screws through a plurality of mounting screw holes 34 provided on a periphery of the jack 12, the shim 26 and the plug component 12. The shim 26 may include at least one self-keying thru slot/non-thru slot 30 having at least one mounting hole 34 for passing at least one screw and the shim 26 also includes a first 0.015" wide groove 32 across the top of the shim 26 and preferably at the center of the shim 26 and a second 0.015" wide groove 32 offset from the center by 0.30". It may be offset from the 90° center either on the 90° center left side or the 90° center right side. A total misalignment of the 0.015" wide groove 32 represents a 1° angular rotation and which acts as a visual aid for the user while precisely aligning the self keying waveguide interconnection system 10. The shim/adapter 26 length is less than the jack 18 counterbore 20 depth. Although one side of the shim/adapter 26 is shown here, the side not shown comprises a counterbore mimicking the jack's 18 counterbore 20 characteristics to preserve the precision alignment when align to the plug 12.

FIG. 2C is a transparent perspective view of the jack 18 of the self-keying waveguide interconnection system 10 according to a preferred embodiment of the invention. The recessed counterbore 20 of the jack 18 from the Lau-Denning interface has a depth sufficient for accommodating the shim 26 and the protruded protruding surface 14 at the center of the plug component 12. The jack 18 remains true to the Lau-Denning interface but the counterbore diameter is increased to accept the modified plug diameter. The number of the plurality of self-keying channels 22 is same as the number of the plurality of self-keying thru slots 30. The depth of the counterbore 20 is such that the assembled self-keying waveguide interconnection system 10 tightly and precisely packs the plug 12, jack 18 and the shim 26 without interleaving any vacant space. The plurality of screws provided on the mounting holes 34 helps to tightly assemble the self-keying waveguide interconnection system 10. This helps to maintain the integrity of the electrical performance of the self-keying waveguide.

Figure 4:
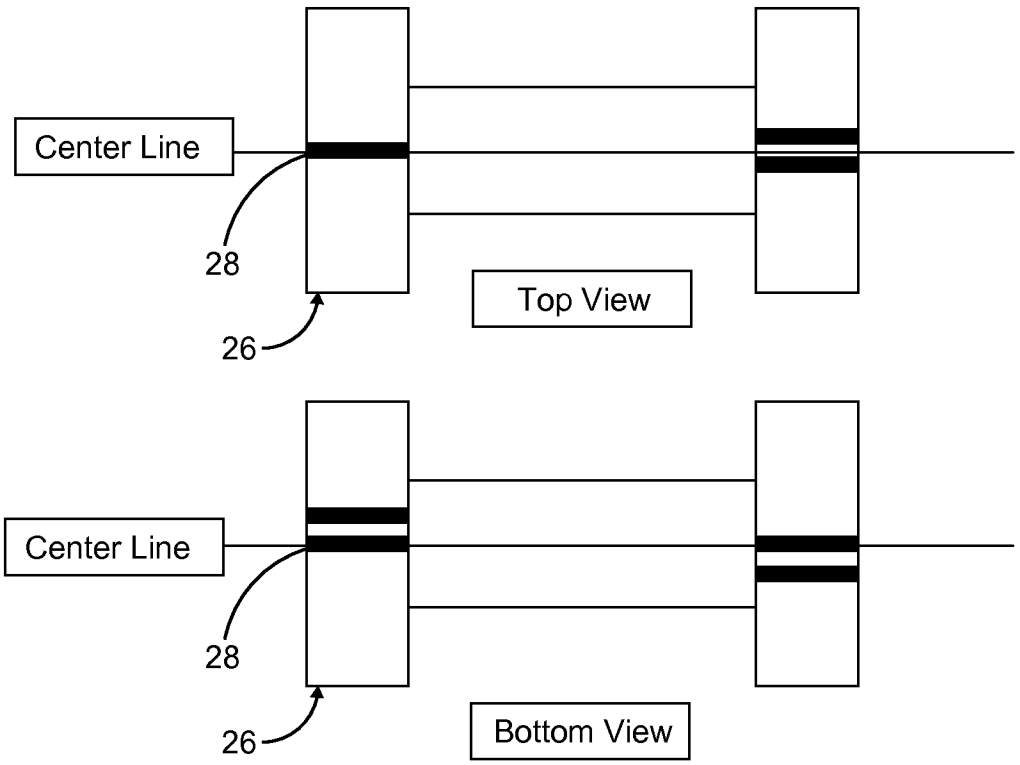
FIG. 4 is a second diagrammatic image depicting a simple method of assuring the flange face orientation and the visual angular rotation of a conventional waveguide used with the improved self-keying system.

FIG. 3 is a first diagrammatic image depicting a simple method of assuring a flange face orientation and a visual angular rotation of a conventional waveguide used with the self keying waveguide interconnection system 10 and FIG. 4 is a second diagrammatic image depicting a simple method of assuring the flange face orientation and the visual angular rotation of a conventional waveguide used with the improved self-keying system 10. This simple method assures the flange face orientation and the visual angular rotation for the Lau-Denning interface. This shows that when the present invention is used with the Lau-Denning interface, the preservation of the flange interface orientation remains during re-attachment after detachment. Furthermore, the flat spots serve two purposes—run-away prevention and accessing points to remove the shim or adapter. The angular rotation can align the centrally disposed apertures 28 of the present invention with the Lau-Denning interface. This method may be extended to the standard MIL-STD 3922/67D waveguide flange for better repeatability measurements.

Figure 5:
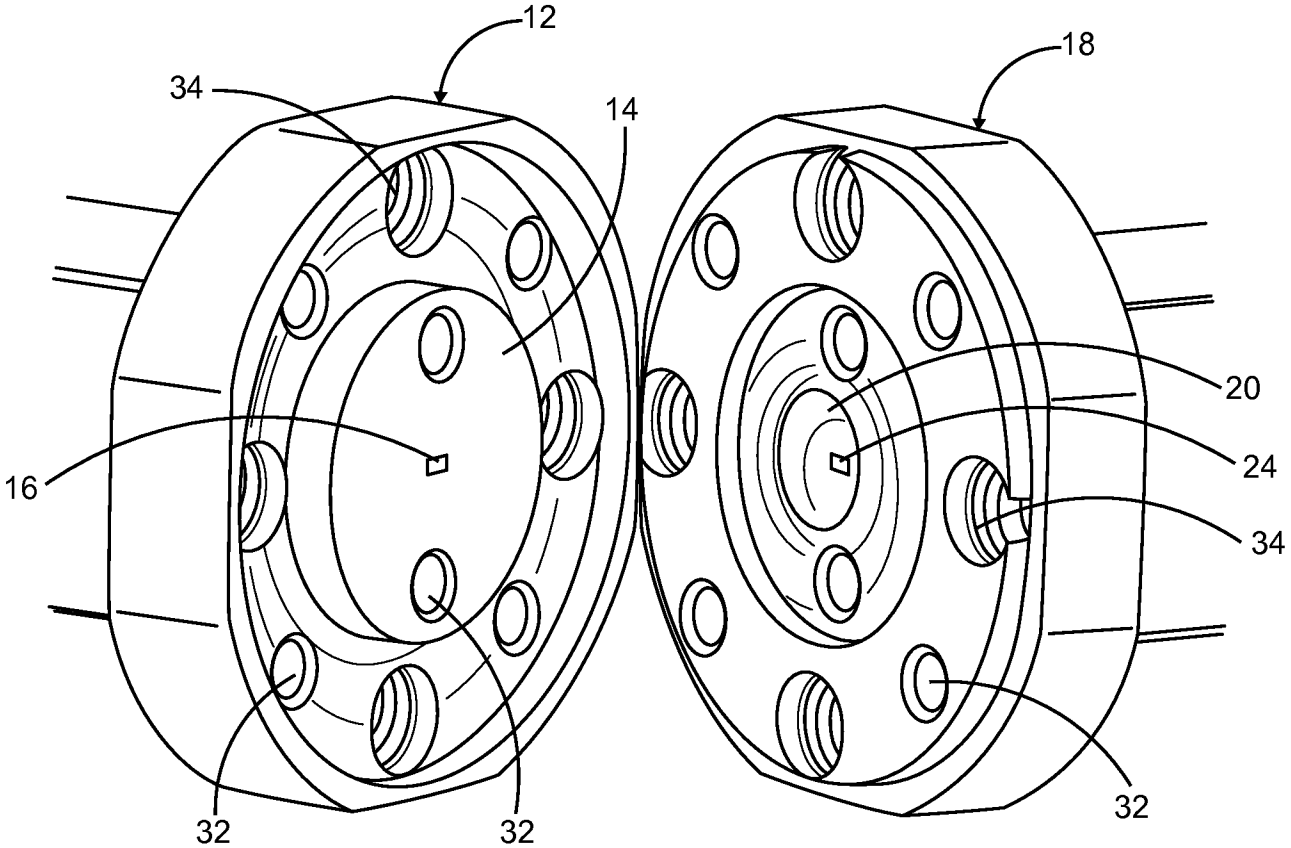
FIG. 5 is a perspective view of a conventional waveguide interface plug and jack.

FIG. 5 is a perspective view of a conventional waveguide interface plug 12 and jack 18. The jack 18 remains true to the Lau-Denning interface but the counterbore diameter is increased to accept the modified plug diameter. The plug (boss) component 12 can also be seen in FIG. 5 while the interface having an increased counterbore diameter is shown in FIG. 6. FIG. 6 is a perspective view of the plug 12 and the jack 18 having the plurality of self-keying thru slots 22 according to a preferred embodiment of the invention. Flat spots are added to both the plug 12 and jack 18 components to reduce the "run away" effect as a result of an unleveled surface. Thus, damage to the waveguide flange is prevented. At least one slot is introduced around the outer jack diameter to act as part of the self-keying elements for the shim/adapter 26.

FIG. 7 is a perspective view of the plug 12 and the shim 26 positioned on the plurality of self-keying channels 22 of the jack 18 according to a preferred embodiment of the invention. Although the shim/adapter 26 shown in FIG. 8 depicts at least nine self-keying features, a minimum of at least one self-keying feature is sufficient to acquire the high precision alignment disclosed in this application. In the case where the width of the shim 26 is less than the depth of the jack counterbore 20, at least one thru slot 30 is necessary to create the self-keying position(s). As the shim's slot or slots 30 are orientated to match the identical slot or slots or channels 22 orientation in the jack 18, a gentle push of the shim 26 toward the jack 18 will automatically sit and lock the shim 26 accurately into the jack 18 counterbore, making a very precise or ideal aperture interface between one side of the shim 26 and the jack 18. With the shim recess inside the jack's counterbore 20, the jack 18, complete with seated shim as shown in FIG. 8, may then be coupled to the plug 12 as a single entity. Because the jack 18 and the plug 12 have a very precise aperture interface and the shim aperture from one side of the shim 26 to the other side of the shim 26 is identical, the shim aperture and the plug aperture may be coupled precisely. With the shim aperture and the plug aperture coupled precisely, the shim 26 is not visible when viewing the connection between jack 18 and plug 12 from the outside. Hence, the self-keying method of coupling multiple interfaces preserves the tight aperture interface condition set forth by the Lau-Denning interface. In the case where the shim or adapter 26 width exceeds the jack counterbore depth, the non-thru slot or non-thru slots 30 is fabricated to be slightly less than the jack counterbore 20 depth.

FIG. 8 shows a top perspective view of the shim 26 having a shape complementary to the plurality of self-keying channels 22 according to a preferred embodiment of the invention. The shim/adapter 26 comprises at least one non-thru slot 30 having a depth slightly less than the jack counterbore 20 depth therefore preserving the self-keying properties and the precision alignment. As the shim's at least one non thru slot 30 is orientated to match the identical at least one channel's 22 orientation in the jack 18, a gentle push of the shim 26 toward the jack 18 will automatically sit and lock the shim 26 accurately into the jack counterbore 20 without interference from the shim's slot or slots 30, making a very precise or ideal aperture interface between one side of the shim 26 and the jack 18. With one side of the shim 26 locked to the jack counterbore 20 and the other side of the shim 26 having a counterbore located in the same position as the jack counterbore 20, the jack 18 with the shim 26 can couple to the plug 12 as a single entity. Again, since the shim aperture from one side of the shim 26 to the other side of the shim 26 is identical and having the shim open side mimicking the jack counterbore 20, the coupling of the jack 18 and the plug 12 with the shim 26 thicker than the jack counterbore 20 retains the very precise aperture interface set forth by the Lau-Denning interface. Therefore, the thicker shim 26 between the jack 18 and the plug 12 is not visible from the outside, similarly to the thinner shim 26 between the jack 18 and the plug 12. Hence, the self-keying method of coupling multiple interfaces preserves the tight aperture interface condition set forth by the Lau Denning interface. In use, the self-keying shim 26 maintains the integrity of the electrical performance of the waveguide.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

I claim:

1. A self keying waveguide interconnection system for repeatable waveguide calibration and connection comprising:

a first member, the first member being a plug component provided with a protruding surface having a centrally disposed aperture therethrough for a connection to a first duct;

a second member, the second member being a jack provided with a counterbore complimentary to the protruding surface to accept a plug diameter, the second member comprising a plurality of self keying channels, the counterbore comprising a centrally disposed aperture therethrough for connection to a second duct to join the first duct to the second duct; and a shim having a shape complementary to the plurality of self keying thru channels and having dimensions to position within the counterbore and a plurality of self keying thru slots, the shim having a centrally disposed aperture therethrough for aligning the centrally disposed aperture of the first member to the centrally disposed aperture of the second member, the shim having a width less than a counterbore depth;

whereby the shim accurately fits onto the counterbore and the self keying thru slots of the second member to align the centrally disposed apertures of the first member, the second member and the shim to maintain integrity of the electrical performance of the self keying waveguide.

2. The system of claim 1 wherein the first member includes a first member plurality of holes for aligning with a second member plurality of holes provided within a periphery of the second member and a shim plurality of holes provided on the shim to precisely align the centrally disposed apertures of the first member, the second member and the shim to maintain integrity of the electrical performance of the self keying waveguide interconnection system.

3. The system of claim 1 wherein the plurality of holes of the first member, the second member and the shim are secured to a precisely aligned position utilizing a plurality of engagement means deposited on to the plurality of holes.

4. The system of claim 1 wherein the self-keying thru slots allow the self keying waveguide formed by joining the first member, the second member and the shim to maintain an ultra precision interface coupling by precisely aligning the centrally disposed apertures.

5. The system of claim 1 wherein the shim comprises a first wide groove of approximately 0.015" across a top of the shim, the center of the first wide groove aligning with an axis passing through an approximately 90° center of the shim and a second wide groove of approximately 0.015" offset from the approximately 90° center by approximately 0.30".

6. The system of claim 5 wherein the second wide groove of approximately 0.015" may be offset from the approximately 90° center either on an approximately 90° center left side and/or an approximately 90° center right side.

7. The system of claim 6 wherein a total misalignment of the first wide groove of approximately 0.015" and/or the second wide groove of approximately 0.015" represents an angular rotation of approximately 1°.

8. The system of claim 7 wherein the total misalignment representing the angular rotation of approximately 1° creates a visual aid to assists a user to align the angular rotation to within less than 1°.

9. The system of claim 1 wherein the shim when coupled to a plurality of components, including another waveguide flange, indicates a flange interface polarity to ensure that same mating interface polarity is maintained when the plurality of components are re-attached after detachment.

10. The system of claim 1 wherein the shape of the shim is complementary to the plurality of self keying thru slots and is sized to position within the counterbore and the plurality of self keying thru slots.

11. The system of claim 1 wherein at least one of the pluralities of self-keying thru slots is necessary to create a self-keying position thereby maintaining the ultra precision interface coupling by precisely aligning the centrally disposed apertures.

12. The system of claim 1 wherein the centrally disposed aperture of the shim aligns with the centrally disposed aperture of the first member to the centrally disposed aperture of the second member, the width of the shim is less than the counterbore depth.

13. The system of claim 1 wherein the plurality of self keying thru slots of the shim is orientated to match the orientation of the plurality of self keying channels in the jack, a gentle push of the shim enables the jack to automatically sit and lock the shim accurately into the jack counterbore upon, making a very precise aperture interface between one side of the shim and the jack.

14. The system of claim 1 wherein the shim recess inside the counterbore of the jack, the jack with the seated shim forms a single entity to be coupled to the plug component.

15. The system of claim 1 wherein a depth of the plurality of self keying thru slots is adjusted to match with the width of the shim to preserve the self-keying position and to achieve a precision alignment, the depth of the plurality of self keying thru slots is fabricated to be slightly less than the counterbore depth where the shim width exceeds the counterbore depth.

16. A method of forming a self keying waveguide interconnection system for repeatable waveguide calibration and connection, the method comprising the steps of:

providing a first member, the first member being a plug provided with a protruding surface having a centrally disposed aperture therethrough for connection to a first duct;

providing a second member, the second member being a jack provided with a counterbore complimentary to the protruding surface, a plurality of self keying thru channels and a centrally disposed aperture therethrough for connection to a second duct to join the first duct to the second duct;

placing and locking a shim having a shape complementary to the plurality of self keying thru channels and a centrally disposed aperture within the counterbore and a plurality of self keying thru slots, wherein the shim enables the jack to automatically sit and lock the shim accurately into the jack counterbore thereupon, making an aperture interface between one side of the shim and the jack; and coupling the plug with the shim recessed inside the counterbore of the jack to form an interface coupling by precisely aligning the centrally disposed apertures of the plug, the jack and the shim.

17. The method of claim 16 wherein the plug and the jack includes a plurality of flat spots to prevent damage to a waveguide flange.

18. The method of claim 16 wherein the jack with the shim seated precisely in the plurality of self-keying thru slots forms a single entity for coupling to the plug component.

19. The method of claim 16 wherein the shim has a width less than a counterbore depth, and wherein the plug, the shim and the jack are coupled precisely.

* * * * *